United States Patent [19]

Walker

[11] 3,989,128

[45] Nov. 2, 1976

[54] WHEELED SUITCASE

[76] Inventor: Brooks Walker, 807 Francisco St., San Francisco, Calif. 94104

[22] Filed: Aug. 29, 1975

[21] Appl. No.: 608,921

[52] U.S. Cl. ..... 190/18 A

[51] Int. Cl.[2] ..... A45C 5/14

[58] Field of Search ..... 190/18 A, 18 R; 16/30, 16/43; 280/47.13 R, 47.24, 47.26

[56] References Cited

UNITED STATES PATENTS

| | | | |
|---|---|---|---|
| 441,433 | 11/1890 | Mead | 16/30 |
| 1,495,093 | 5/1924 | Mock | 190/18 A X |
| 1,541,280 | 6/1925 | Replogle | 16/30 |
| 2,567,185 | 9/1951 | Coviello | 16/30 |
| 2,919,138 | 12/1959 | Brower | 190/18 A X |
| 3,526,921 | 9/1970 | Aupke | 16/43 |
| 3,799,568 | 3/1974 | Hager | 190/18 A X |
| 3,805,929 | 4/1974 | Kuwayama | 190/18 A |

FOREIGN PATENTS OR APPLICATIONS

| | | | |
|---|---|---|---|
| 2,103,106 | 7/1972 | Germany | 190/18 A |

*Primary Examiner*—Donald F. Norton
*Attorney, Agent, or Firm*—Gordon Wood

[57] ABSTRACT

The ground wheels of a wheeled suitcase are provided with a mount and a socket is fixed to the suitcase to permit the wheels to be readily secured and removed. The socket provided on the suitcase is of minimal thickness and formed so as to obviate snagging with adjacent articles while the suitcase is being transported in the normal manner without wheels.

7 Claims, 9 Drawing Figures

WHEELED SUITCASE

This invention relates to suitcases of the type provided with ground wheels to facilitate transporting the same. The main object of the present invention is the provision of a wheel structure and means on the suitcase to mount said structure so that the wheels may be readily applied and removed therefrom.

Another object of the invention is the provision of a socket on the suitcase which is adapted to receive the wheel structure therein and which socket is designed to be relatively thin and shaped so as to minimize damage to adjacent articles or to the socket itself.

Also by the present invention, when the wheels are detached from the case the wheel axles and blades nest closely and occupy a minimum of carrying space. Furthermore, the weight of the case helps hold the blades in the suitcase socket even when turning or on a banked surface.

Other objects and advantages will be apparent from the following specification and from the drawings.

Figures 1, 2, 3, 4, 5, 6, 7, 8, 9:
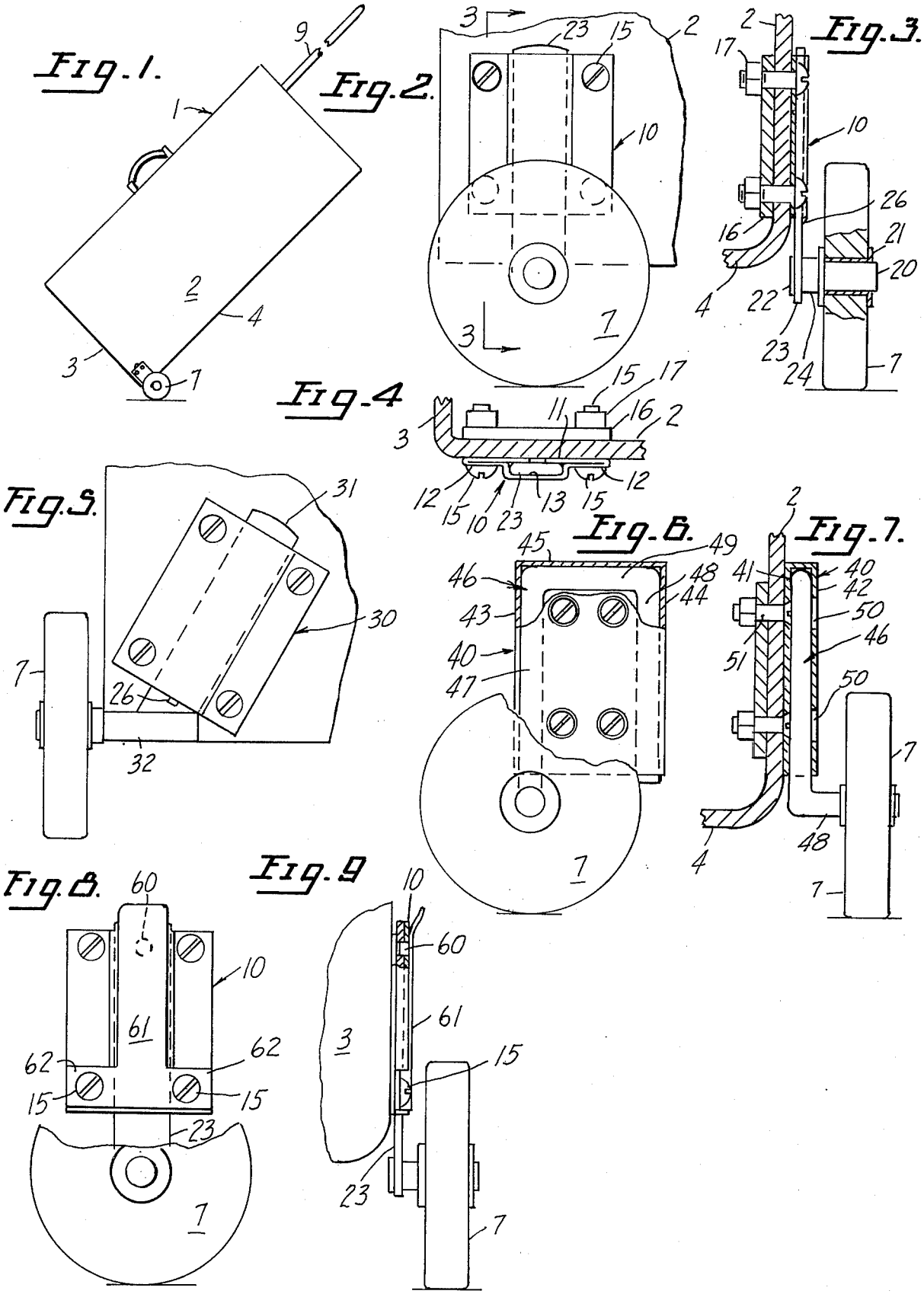
FIG. 1 is a side elevation of a wheeled suitcase incorporating the invention.
FIG. 2 is a greatly enlarged fragmentary side elevation of the suitcase in FIG. 1 showing the wheel structure and the socket therefor.
FIG. 3 is a vertical sectional view taken in a plane indicated by lines 3—3 by FIG. 2.
FIG. 4 is a top plan view of the structure of FIG. 2 showing a portion of the suitcase in section, and with the wheel omitted.
FIG. 5 is a view similar to FIG. 2 showing a modified form of the invention.
FIGS. 6 and 7 are views similar to FIGS. 2 and 3 showing another modified form of the invention.
FIGS. 8 and 9 are views similar to FIGS. 2 and 3 and showing a locking device preventing the accidental removal of the wheel.

The invention is adapted to be employed with a conventional suitcase such as that indicated at 1 in FIG. 1 and which suitcase is provided with a pair of opposite sidewalls 2, an end wall 3 and a bottom wall 4. Secured to the opposite sidewalls 2 are a pair of wheels 7, the mounting means for one of said wheels being shown in FIGS. 2 to 4. The suitcase may be pulled by a removable or telescoping handle such as indicated at 9.

A socket member generally designated 10 is provided. This socket member may be formed of relatively thin gage sheet metal and bent as shown in FIG. 4 to provide an inner wall 11, a pair of flanges 12 and a central vertically extending cavity 13. The sidewall to the suitcase is apertured at four places to receive machine screws 15 or rivets therethrough for securing the socket 10 to the suitcase. A washer plate 16 is preferably provided on the inner face of sidewall 2 so that the structure may be fixedly secured by means of nuts 17 or round rivet ends.

As best seen in FIG. 3 the wheel 7 is provided with an axle 20 on which is press fitted a sleeve bearing 21. The axle 20 may be upset at its inner end 22 to fixedly secure said axle on an upwardly extending relatively narrow blade 23 which is adapted to be slidably received with cavity 13 formed in socket piece 10. The wheel 7 may be spaced apart from blade 23 by means of a spacer 24.

By the above described structure it will be apparent that the socket portion 10 which is permanently secured to the suitcase does not project outwardly from the sidewall of the suitcase sufficiently to snag adjacent articles while the suitcase is being transported in the normal manner without wheels. The edges of the socket may be rounded to further reduce the danger of snagging other suitcases. It will also be seen that the wheel structure including the wheel 7 and the blade 23 may readily be pulled outwardly from the socket 10 in order to remove the wheels when the latter are not being used. In order to limit upward movement of the blade 23 into the socket portion 10 the material of blade 23 may be upset slightly as indicated at 26 to engage the lower edge of the socket 10. By forming the cavity 13 and the blade 23 so that they have a tight sliding fit the friction created is sufficient to prevent the wheel structure from falling out of the cavity when it is desired to pick up the suitcase.

In the embodiment shown in FIG. 5 the socket 30 is similar to the socket 10 in all respects except that it is slantingly disposed to the vertical and secured on the end wall 3 instead of sidewall 2. In this case the blade 31 is fixedly secured as by welding at its lower end to axle 32 on which is rotatably supported the wheel 7. The socket portion 30 of FIG. 5 is even less likely to snag on adjacent articles than the socket 10 of FIG. 2 as suitcases are often slid lengthwise next to each other with sides 2 adjacent each other.

The embodiment shown in FIGS. 6 and 7 includes a socket portion 40 which may be formed of a piece of sheet material to provide an inner wall 41, an outer wall 42, end walls 43, 44 and a top wall 45. The socket portion 40 is open at its lower end to receive therethrough a generally inverted U-shaped mount 46 including parallel spaced legs 47, 48 and cross piece 49. At its lower end vertically extending leg 47 is bent at right angles to provide an axle 48 (FIG. 7) on which the wheel 7 is rotatably supported.

The front wall 42 of socket 40 is provided with holes 50 through which access may be obtained by means of a screwdriver to countersunk machine screws 51 or rivets which secure the socket 40 in place in a similar manner to that shown in FIG. 3.

In the embodiment of FIGS. 6 and 7 it should be noted that the U-shaped mount 46 may be formed so as to be easily inserted into the socket 40 but at the same time the spacing of the legs 47, 48 may be made such that the mount is resiliently secured within said socket. At the same time the mount may be readily removed by pulling outwardly on wheel 7.

In the embodiment of FIGS. 8 and 9 a structure similar to that shown in FIG. 2 is provided except that positive locking means is added to prevent accidental removal of the wheels. In this case the socket 10 is formed with an opening in its outer wall to receive therethrough a pin 60 and the blade 23 is formed with a recess for receiving said pin 60 therein. The pin 60 is mounted on a vertically extending leaf spring 61 which is provided with laterally extending lugs 62 which may be secured in place by means of the screws or rivets 15 shown in FIG. 3. By the structure of FIGS. 8 and 9 the upper end of leaf spring 61 may readily be pulled outwardly to release the pin 60 from blade 10 so as to permit removal of the wheel structure.

It will be noted that in all forms of the invention the socket portion may be formed so as not to extend outwardly any further than the conventional fittings presently found on suitcases.

Although the invention has been found to be effective when only two wheels are used it will be apparent that four wheels may be employed so that the suitcase may be pulled by a leash or the like and other suitcases carried on top of the wheeled lower case.

I claim:

1. In a wheeled suitcase, an axle, a wheel rotatably supported at one end of said axle, a mount secured to the opposite end of said axle with the latter cantilevered therefrom, means on one of the vertically extending sides of said suitcase forming a socket and receiving said mount therein, said socket opening outwardly adjacent the bottom side of said suitcase whereby when said mount is received in said socket said axle is adjacent said bottom side and the upper portion of said wheel is above said bottom side.

2. A wheeled suitcase according to claim 1 wherein said mount is an elongated blade having a width at least three times its thickness.

3. A wheeled suitcase according to claim 2 wherein the length of said blade is at least three times its width and substantially coextensive with the length of said socket.

4. A wheeled suitcase according to claim 2 wherein said blade is slantingly disposed relative to the axis of said axle.

5. A wheeled suitcase according to claim 1 wherein retaining means is provided in said socket preventing removal of said mount.

6. A wheeled suitcase according to claim 5 wherein said retaining means comprises a pin carried by said socket and a hole in said mount receiving said pin therein.

7. A wheeled suitcase according to claim 1 wherein said mount is formed from a rod having a straight portion at one end constituting said axle, the remainder of said rod being bent to a U-shape adapted to be received in said socket.

* * * * *